US006524155B1

(12) United States Patent
Lin

(10) Patent No.: US 6,524,155 B1
(45) Date of Patent: Feb. 25, 2003

(54) BUBBLE-BLOWING TOY

(76) Inventor: Mon-Sheng Lin, 5th Floor, No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 10/188,100

(22) Filed: Jul. 3, 2002

(51) Int. Cl.[7] ..... A63H 33/28

(52) U.S. Cl. ..... 446/16; 446/15; 206/229; 206/457; 215/10; 215/386

(58) Field of Search ..... 446/15, 16, 18, 446/21, 74, 72, 71; 206/229, 457; 215/10, 386, 390, 391

(56) References Cited

U.S. PATENT DOCUMENTS 612,121 A * 10/1898 Rakovsky ..... 446/21
1,124,204 A * 1/1915 Blair ..... 446/20
3,579,898 A * 5/1971 Hein ..... 446/16
4,775,348 A * 10/1988 Collins ..... 446/16
4,995,844 A * 2/1991 McNett et al. ..... 446/21

FOREIGN PATENT DOCUMENTS

FR 260913 A1 * 9/1987

* cited by examiner

*Primary Examiner*—Jacob K. Ackun
*Assistant Examiner*—Bena B. Miller
(74) *Attorney, Agent, or Firm*—Troxell Law Office PLLC

(57) ABSTRACT

A bubble-blowing toy is constructed to include a fluid container holding a bubble fluid, an applicator adapted for picking up the bubble fluid from the fluid container for blowing bubbles, and an ornament holding the fluid container on the inside to keep the fluid container from sight.

5 Claims, 11 Drawing Sheets

BUBBLE-BLOWING TOY

BACKGROUND OF THE INVENTION

1. Field of the Invention

The present invention relates a bubble-blowing toy and, more particularly to such a bubble-blowing toy, which is decorated with an ornament that keeps the bubble fluid container from sight.

2. Description of the Related Art

A variety of bubble-blowing toys are commercially available. FIG. 1 shows a bubble-blowing toy according to the prior art. According to this design, the bubble-blowing toy comprises a fluid container 10' holding a bubble fluid, and an applicator 20' adapted for picking up the bubble fluid from the fluid container 10' for blowing bubbles. The fluid container 10' has an opening 111' through which the applicator 20' is inserted into the fluid container 10' to pick up the bubble fluid. In order to attract children's attention, the fluid container 10' is made according to, for example, the shape of a cartoon character. However, the outer appearance of the figured fluid container cannot show the fine detail of the outer appearance of a particular FIG. or character.

SUMMARY OF THE INVENTION

It is one object of the present invention to provide a bubble-blowing toy, which keeps the fluid container from sight. It is another object of the present invention to provide a bubble-blowing toy, which has a three-dimensional design that attracts children's attention. According to one aspect of the present invention, the bubble-blowing toy comprises a fluid container holding a bubble fluid, an applicator adapted for picking up the bubble fluid from the fluid container for blowing bubbles, and an ornament holding the fluid container on the inside to keep the fluid container from sight. According to another aspect of the present invention, the ornament has a colored three-dimensional design in the outside wall. According to still another aspect of the present invention, the ornament can be made having the shape of a candy stick, toy, animal, cartoon character, plant, etc.

DETAILED DESCRIPTION OF THE PREFERRED EMBODIMENT

Figure 1:
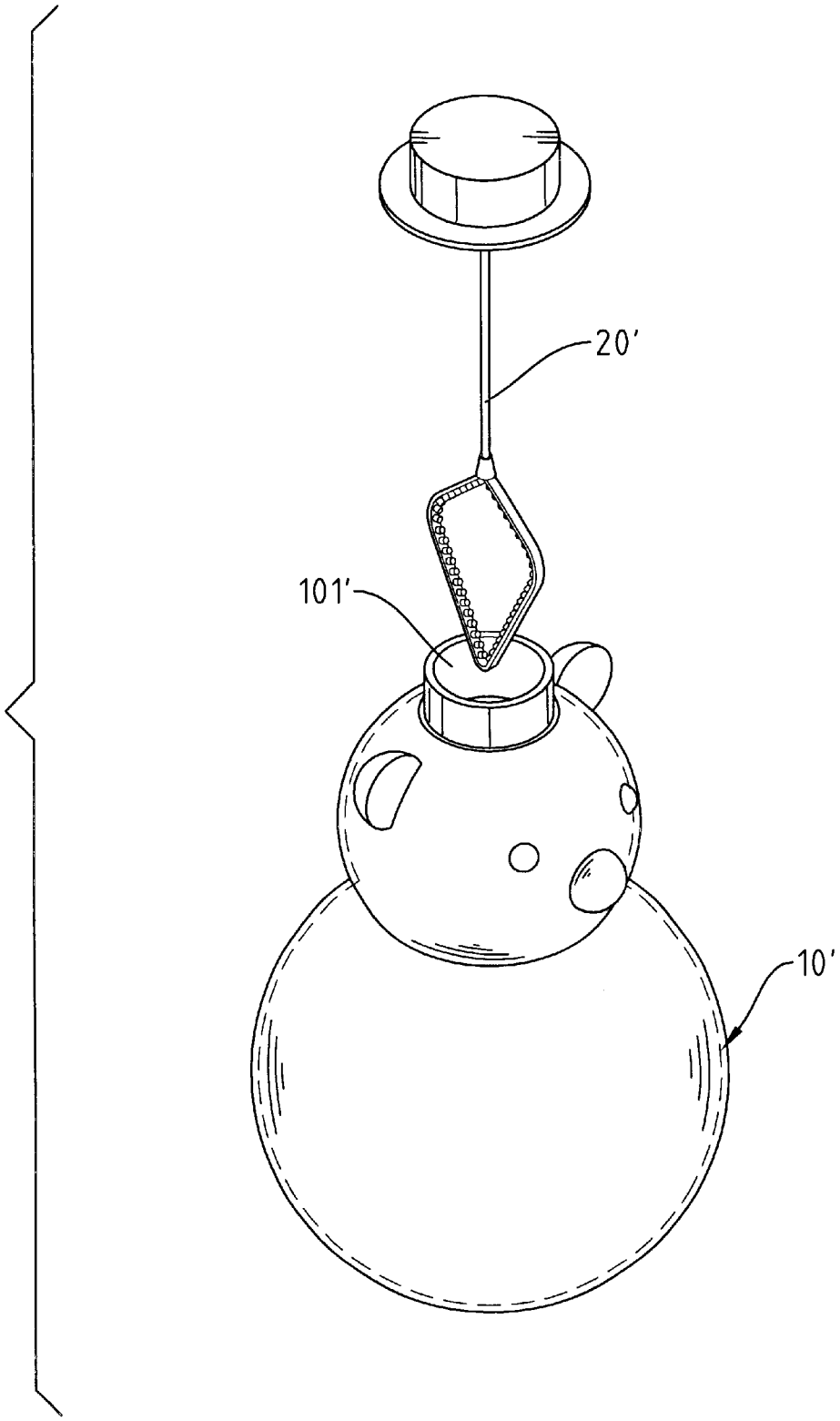
FIG. 1 Prior Art
FIG. 1 is an elevational view of a bubble-blowing toy according to the prior art.

Referring to FIGS. from 2 through 4, a bubble-blowing toy in accordance with the present invention is shown comprised of a fluid container 1, an applicator 2, and an ornament 10. The fluid container 1 comprises a container body 11 holding a bubble fluid for blowing bubbles, and an opening 111 in one end of the container body 11. The tip of the applicator 2 has a hollow rhombic shape convenient for insertion into the opening 111 of the fluid container 1 to pick up a certain amount of the bubble fluid from the container body 11 for blowing big bubbles. The other end of the applicator 2 is a finger knob 21 for the grasp of the fingers. The ornament 10 is molded from resin, acrylic, polyvinyl chloride, or the like, and adapted to hold the fluid container 1 on the inside, keeping the opening 111 of the fluid container 10 exposed to the outside. When the applicator 2 inserted into the container body 11 through the opening 111, the finger knob 21 is fastened to the opening 111 and exposed to the outside of the fluid container 1 and the ornament 10. The ornament 10 keeps the fluid container 1 from sight, having a three-dimensional design 101 in the outside wall. The three-dimensional design 101 may be colored with assorted colors. Further, a wrapper (or transparent plastic packing bag) 3 is covered on the ornament 10 over the three-dimensional design 101, showing the shape of a candy stick.

Figure 2:
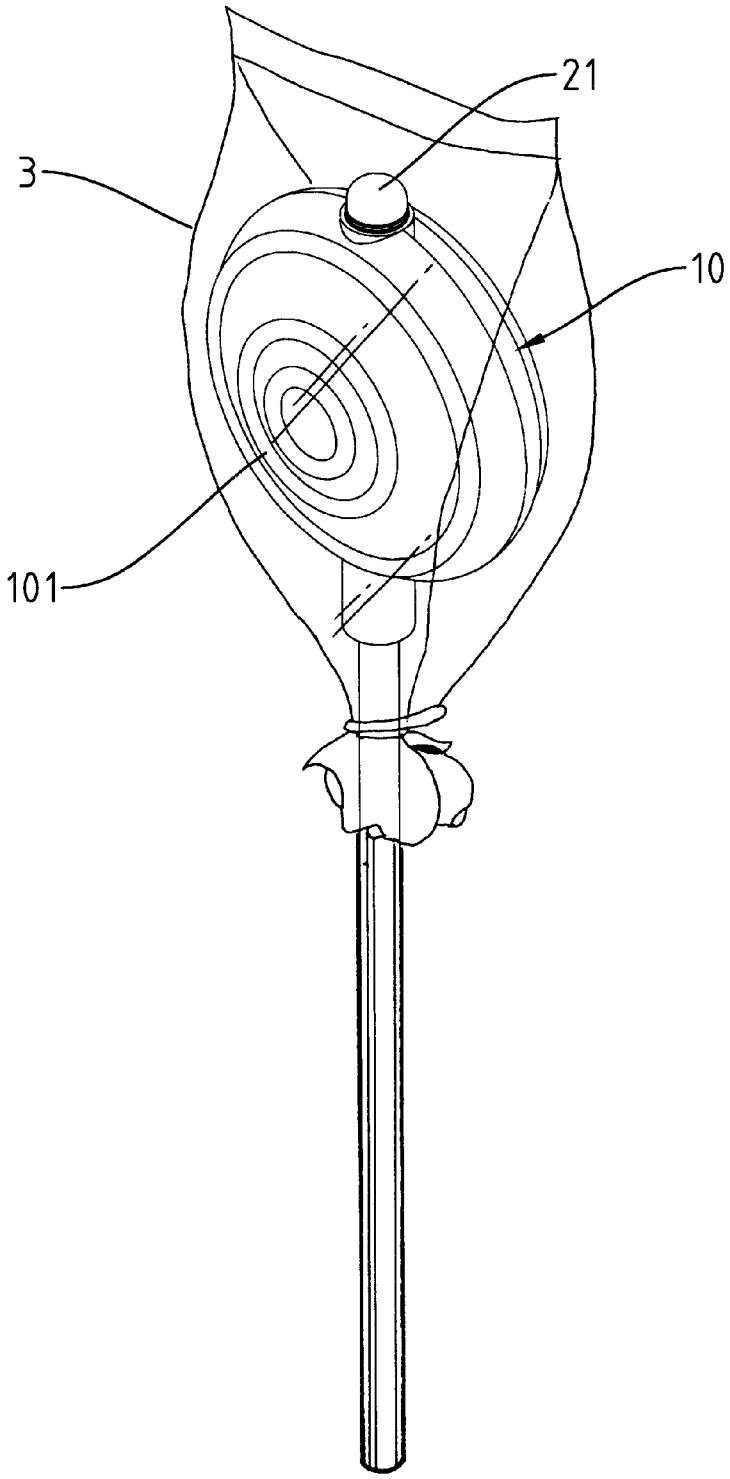
FIG. 2 is a perspective view of a bubble-blowing toy according to the present invention.
Figure 3:
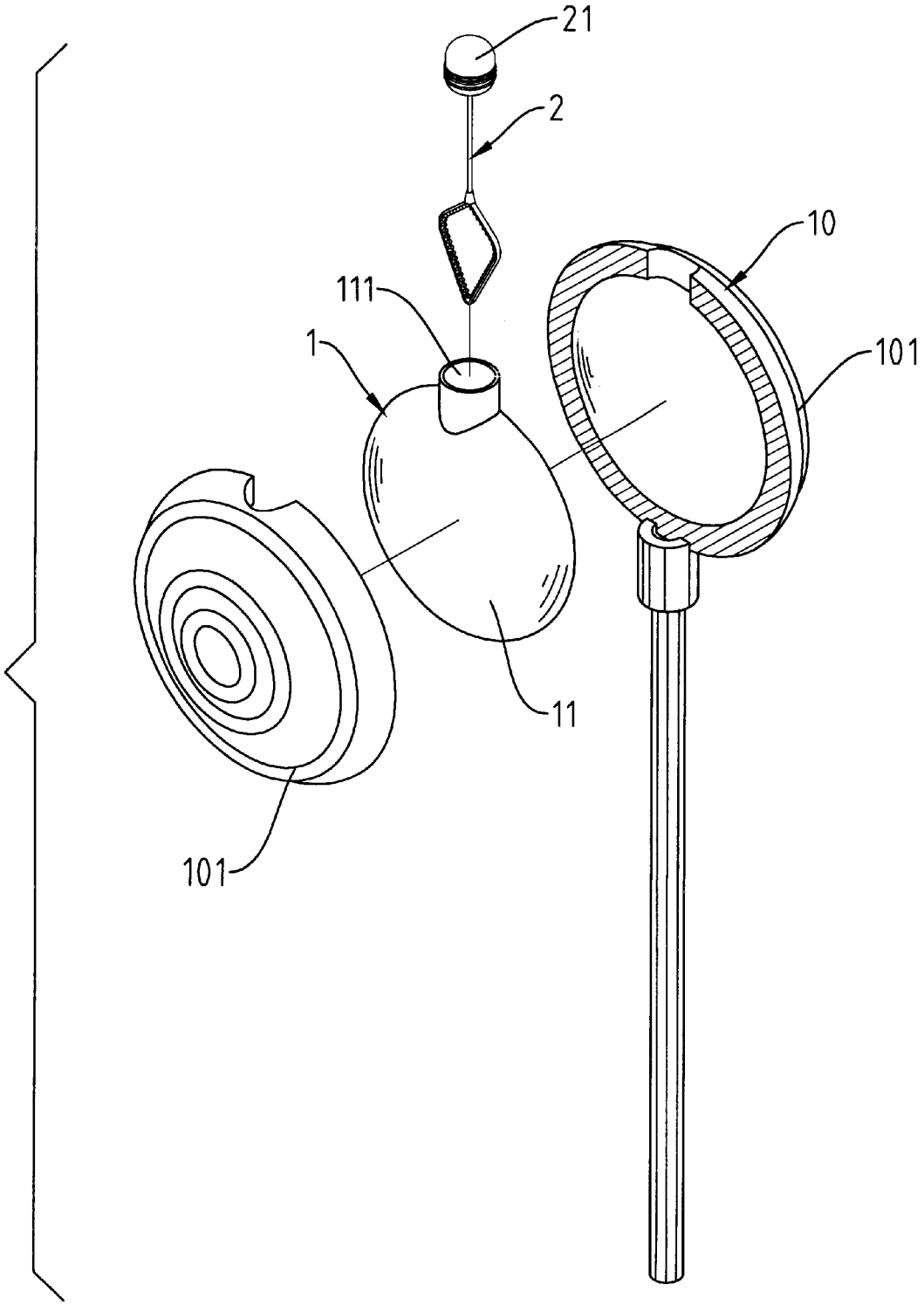
FIG. 3 is an exploded view of the bubble-blowing toy shown in FIG. 2.
Figure 4:
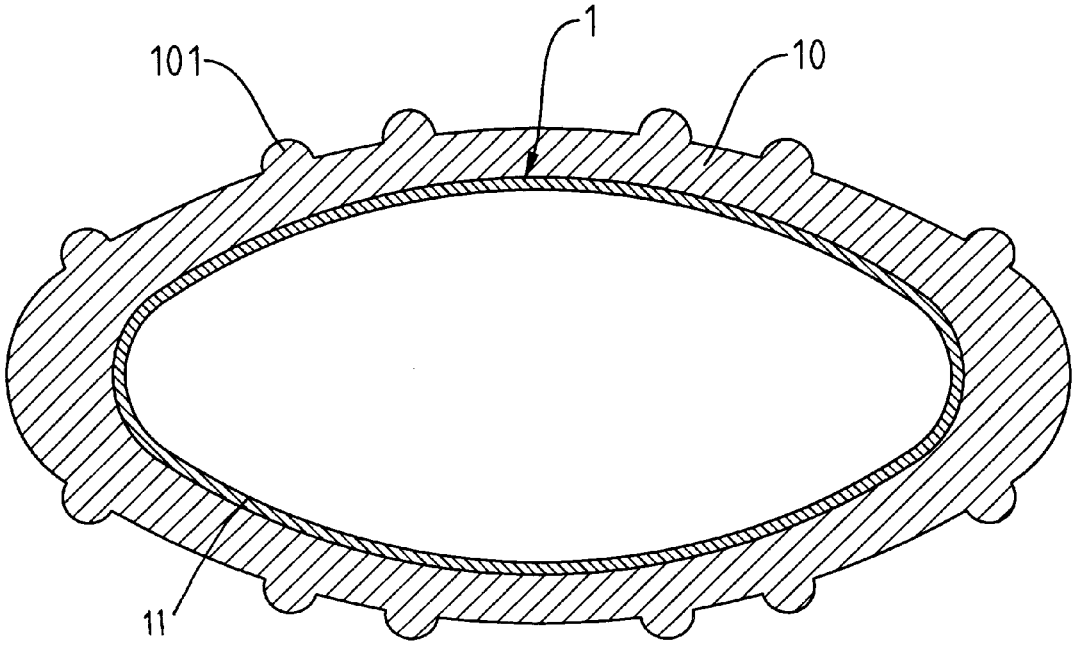
FIG. 4 is a cross-sectional view in an enlarged scale of the bubble-blowing toy shown in FIG. 2.
Figure 5:
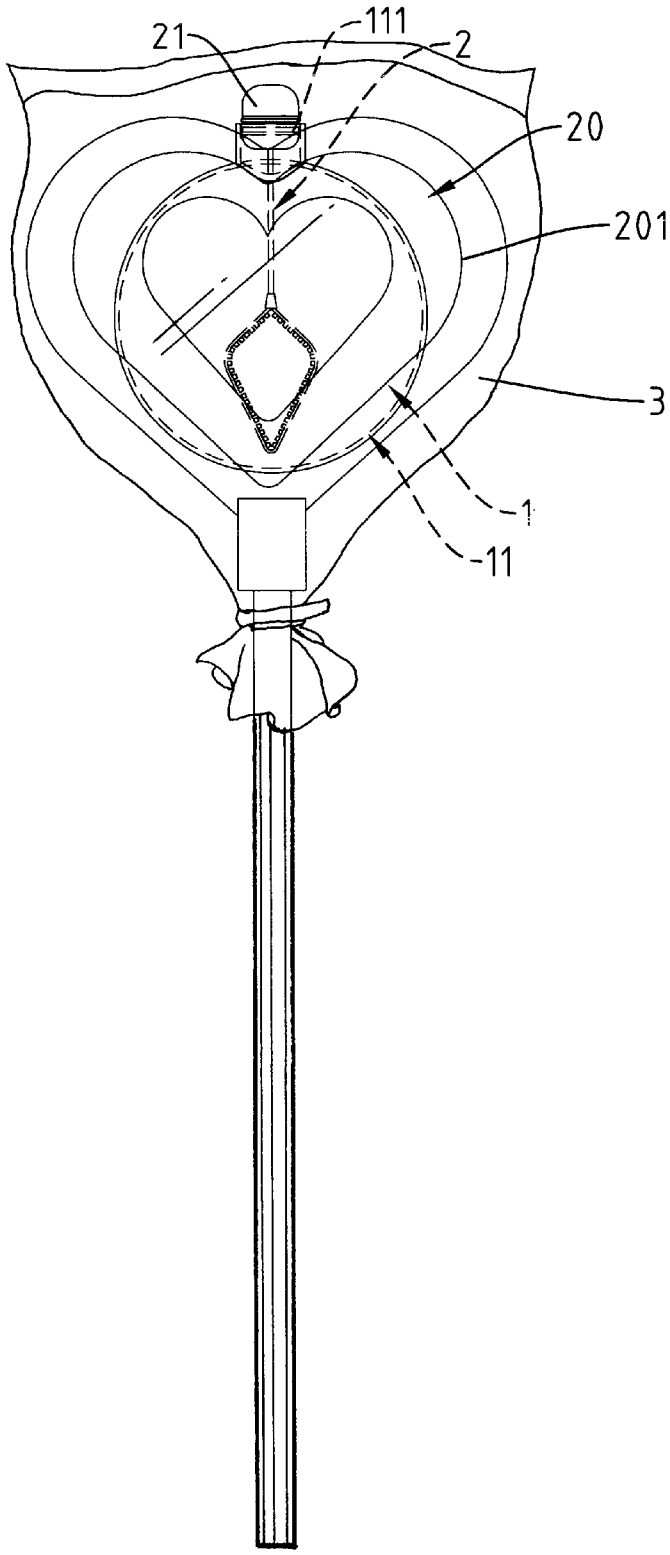
FIG. 5 is a schematic drawing of an alternate form of the bubble-blowing toy according to the present invention.

FIG. 5 shows an alternate form of the present invention. This embodiment is similar to the embodiment shown in FIG. 2 with exception of the design of the ornament. According to this embodiment, the ornament, referenced by 20, has a heart-like three-dimensional design 201.

Figure 6:
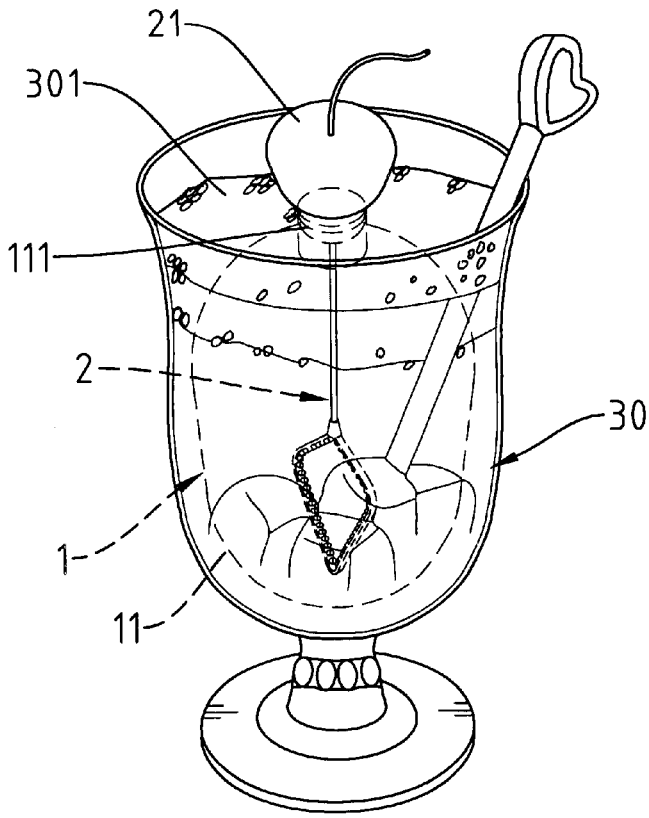
FIG. 6 is a schematic drawing of another alternate form of the bubble-blowing toy according to the present invention, showing the ornament shaped like a cup of fruit gel.

FIG. 6 shows another alternate form of the present invention. According to this alternate form, the ornament, referenced by 30, has the shape of a glass, and the three-dimensional design 301 of the ornament 30 is shaped like a fruit gel.

Figure 7:
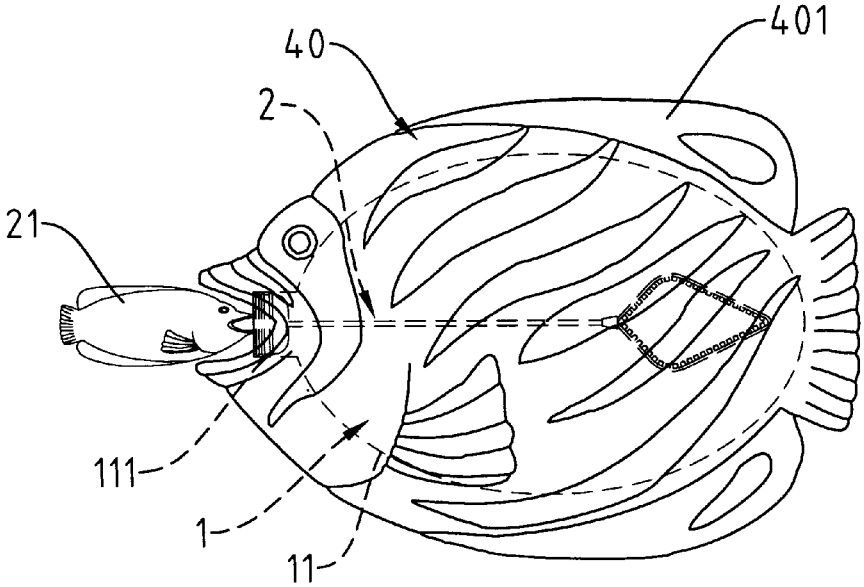
FIG. 7 is a schematic drawing of still another alternate form of the bubble-blowing toy according to the present invention, showing the ornament shaped like a fish.

FIG. 7 shows still another alternate form of the present invention. According to this alternate form, the ornament, referenced by 40, has the shape of a fish, and the three-dimensional design 401 of the ornament 40 is shaped like the fins of the fish.

Figure 8:
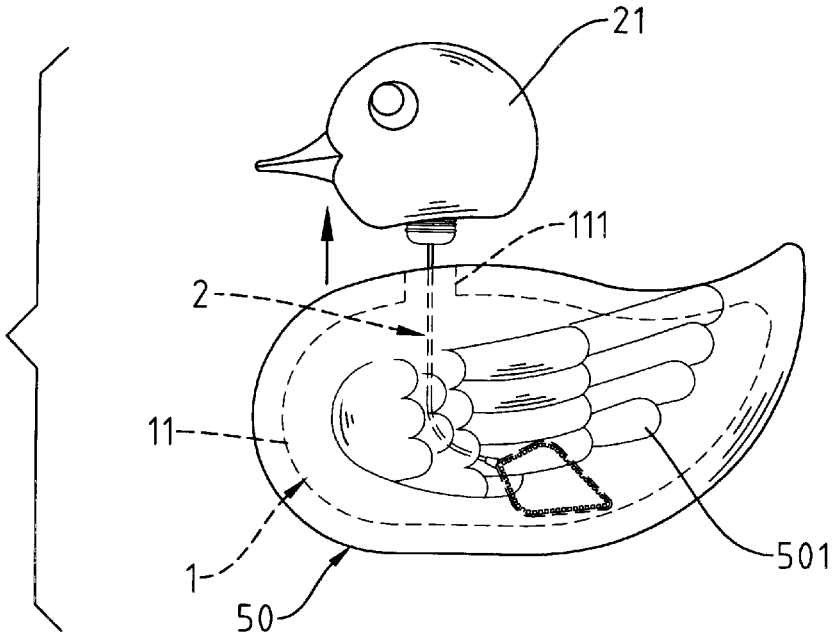
FIG. 8 is a schematic drawing of still another alternate form of the bubble-blowing toy according to the present invention, showing the ornament shaped like a duck.

FIG. 8 shows still another alternate form of the present invention. According to this alternate form, the ornament, referenced by 50, has the shape of the body of a duck, the three-dimensional design 501 of the ornament 50 is shaped like the wings of a duck, and the finger knob 21 of the applicator 2 is shaped like the head of the duck.

Figure 9:
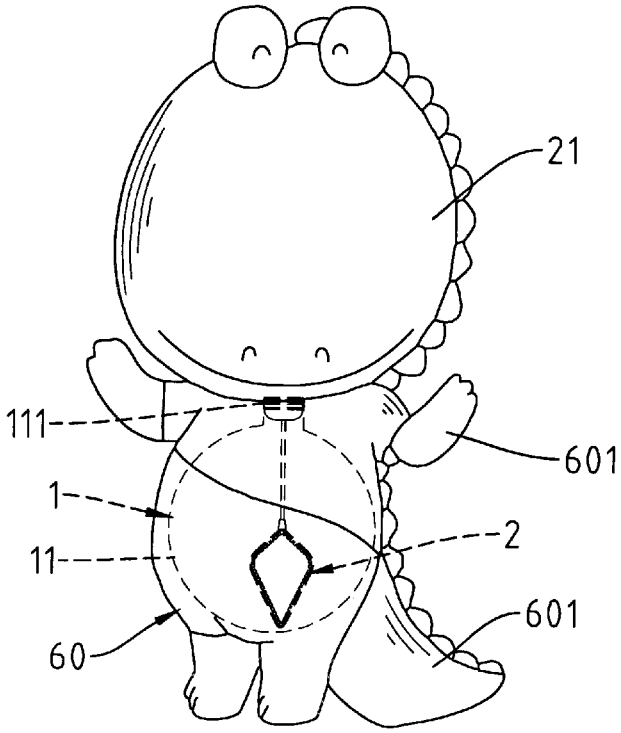
FIG. 9 is a schematic drawing of still another alternate form of the bubble-blowing toy according to the present invention, showing the ornament shaped like a dinosaur.

FIG. 9 shows still another alternate form of the present invention. According to this alternate form, the ornament, referenced by 60, has the shape of a dinosaur, the three-dimensional design 601 of the ornament 60 is shaped like the skin of a duck, and the finger knob 21 of the applicator 2 is shaped like the head of the dinosaur.

Figure 10:
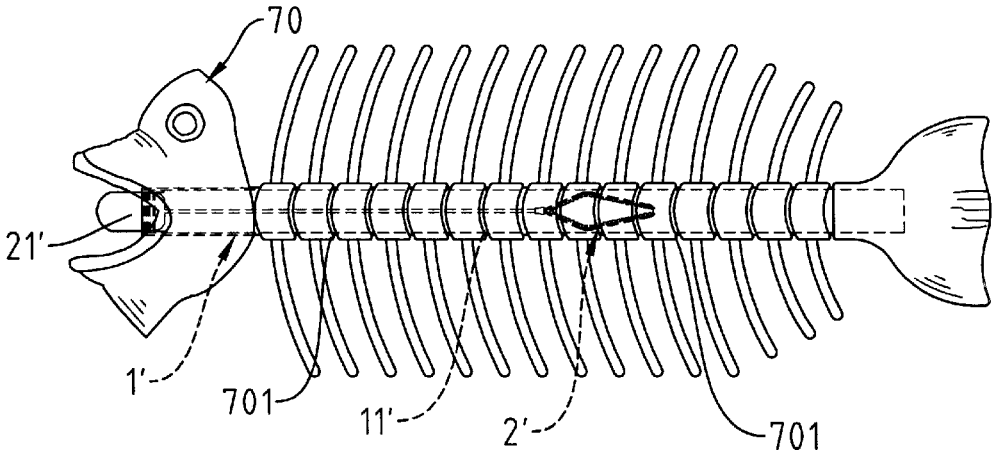
FIG. 10 is a schematic drawing of still another alternate form of the bubble-blowing toy according to the present invention, showing the ornament shaped like the skeleton of a fish.

FIG. 10 shows still another alternate form of the present invention. According to this embodiment, the bubble-blowing toy is comprised of a fluid container 1', an applicator 2', and an ornament 70. The fluid container 1' comprises a cylindrical container body 11' and an opening 111' in one end of the cylindrical container body 11'. The applicator 2' is inserted into the fluid container 1', having one end terminating in a finger knob 21', which is fastened to the opening 111'. The ornament 70 is shaped like the skeleton of a fish. The three-dimensional design 701 of the ornament 70 is shaped like the vertebral column of the fish's skeleton.

Figure 11:
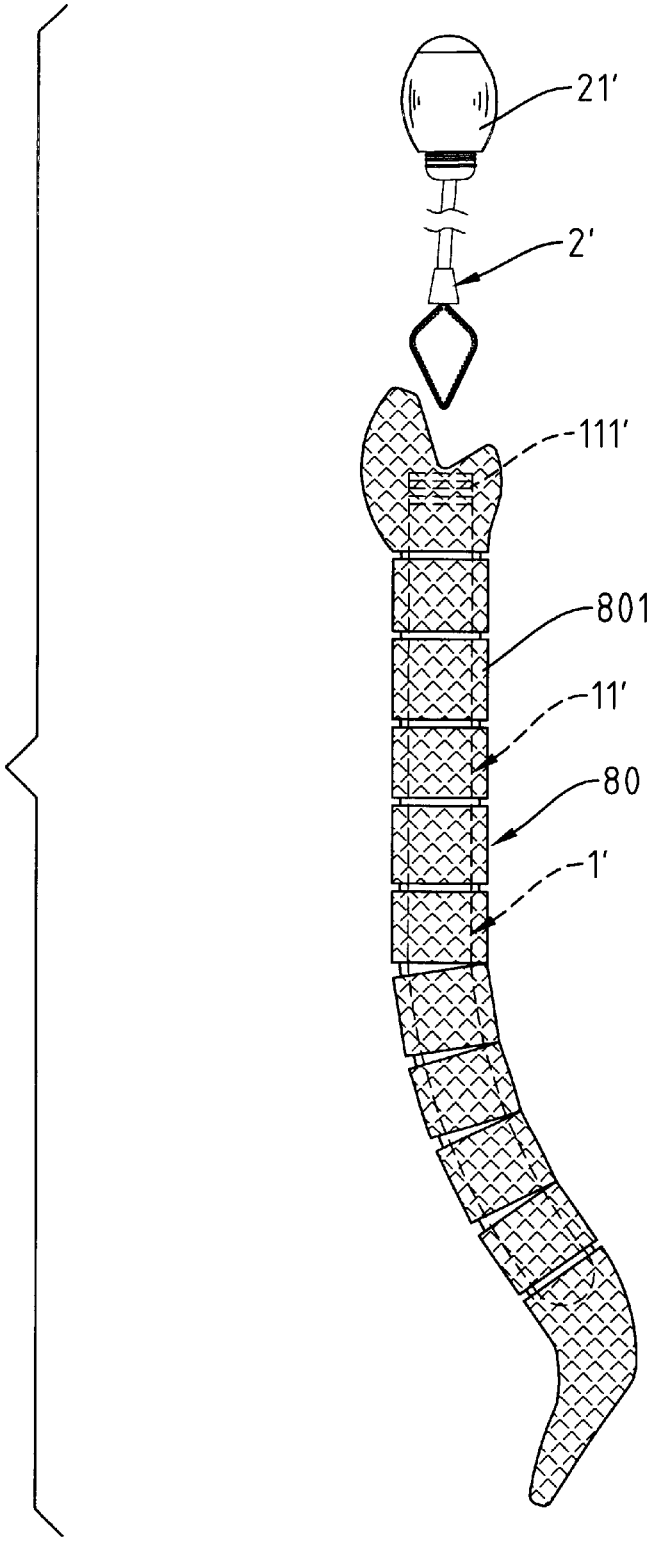
FIG. 11 is a schematic drawing of still another alternate form of the bubble-blowing toy according to the present invention, showing the ornament shaped like a snake.

FIG. 11 shows still another alternate form of the present invention. According to this alternate form, the ornament 80 is shaped like a snake, and the three-dimensional design 801 of the ornament 80 is shaped like the skin of the snake.

Figure 12:
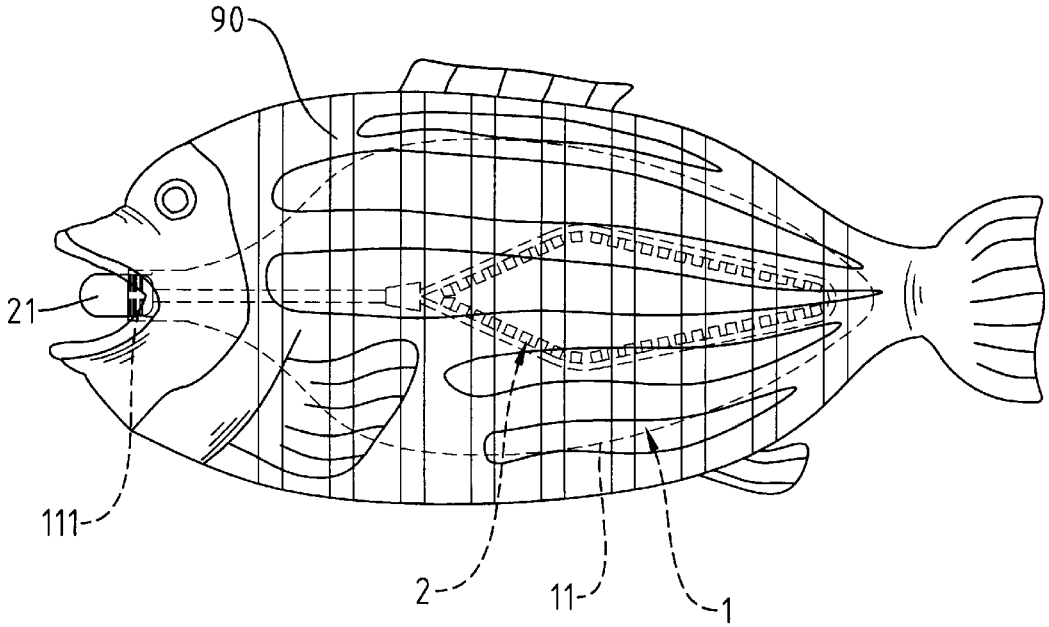
FIG. 12 is a schematic drawing of still another alternate form of the bubble-blowing toy according to the present invention, showing the ornament shaped like a fish.
Figure 13:
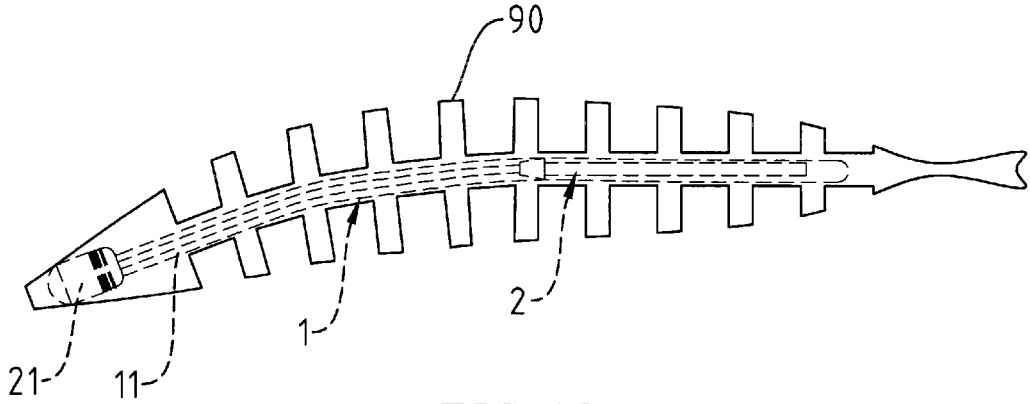
FIG. 13 is a schematic drawing of still another alternate form of the bubble-blowing toy according to the present invention, showing the ornament shaped like a fish.

FIGS. 12 and 13 show still another alternate form of the present invention. According to this embodiment, the ornament 90 is made of flexible material, having the shape of a fish.

Figure 14:
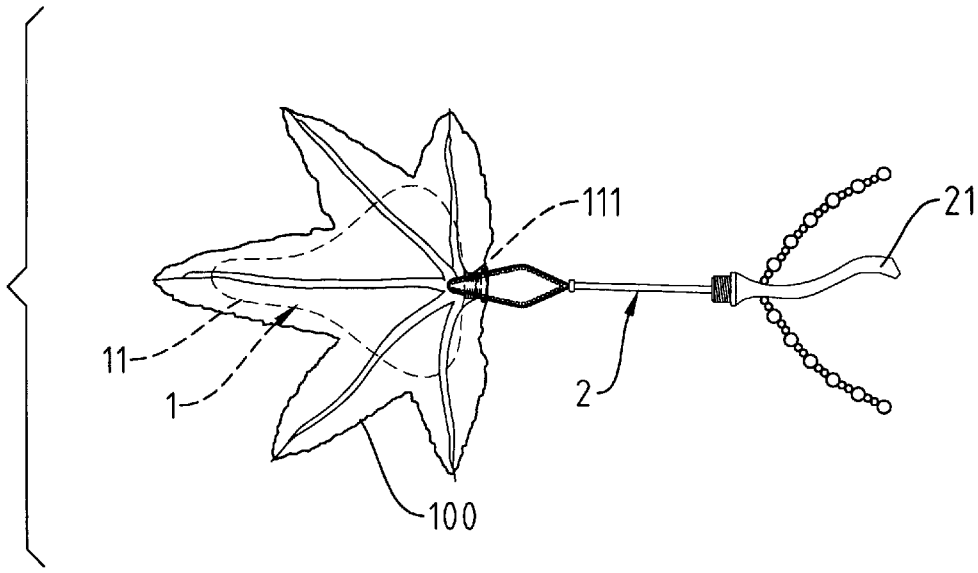
FIG. 14 is a schematic drawing of still another alternate form of the bubble-blowing toy according to the present invention, showing the ornament shaped like the blade of a plant's leaf.

FIG. 14 shows still another alternate form of the present invention. According to this alternate form, the ornament 100 has the shape of the blade of a plant's leaf, the finger knob 21 of the applicator 2 is shaped like the stem of the leaf. Further, a chain may be fastened to the finger knob 21 for enabling the bubble-blowing toy to be hung on the user's neck.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A bubble-blowing toy comprising a fluid container holding a bubble fluid, and an applicator adapted for picking up said bubble fluid from said fluid container for blowing bubbles, wherein an ornament is provided holding said fluid container on the inside to keep said fluid container from sight; said fluid container has an opening extended to the outside of said ornament.

2. The bubble-blowing toy as claimed in claim 1, wherein said ornament has a colored three-dimensional design.

3. The bubble-blowing toy as claimed in claim 1, wherein said fluid container comprises a cylindrical container body, said cylindrical container body having one end terminating in said opening.

4. The bubble-blowing toy as claimed in claim 1, wherein said ornament is fixedly covered on said fluid container.

5. The bubble-blowing toy as claimed in claim 1, wherein said ornament is a flexible member holding said fluid container on the inside.

* * * * *